US006254081B1

(12) United States Patent
Rasmussen et al.

(10) Patent No.: US 6,254,081 B1
(45) Date of Patent: Jul. 3, 2001

(54) REGULATING VACUUM HOLD OF MEDIA IN A PRINTER

(75) Inventors: Steve O. Rasmussen, Vancouver, WA (US); Steven B. Elgee, Portland, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/324,685

(22) Filed: Jun. 3, 1999

(51) Int. Cl.[7] ..... B65H 3/12; B65H 3/08; B65H 7/12

(52) U.S. Cl. ..... 271/96; 271/108; 271/262

(58) Field of Search ..... 399/389, 406; 346/125; 347/106, 16; 271/108, 262, 96, 265.04, 276, 196, 197, 263

(56) References Cited

U.S. PATENT DOCUMENTS

| | | | | |
|---|---|---|---|---|
| 3,722,441 | * | 3/1973 | Kitchner | 112/205 X |
| 3,954,260 | * | 5/1976 | Morello | 271/12 X |
| 4,222,556 | * | 9/1980 | Chapman et al. | 271/3.1 X |
| 4,298,277 | * | 11/1981 | Silverburg | 365/76 X |
| 4,369,964 | * | 1/1983 | Jinnia et al. | 271/260 X |
| 4,420,150 | * | 12/1983 | Umezawa | 271/11 |
| 4,792,249 | * | 12/1988 | Lahr | 400/578 X |
| 4,917,512 | | 4/1990 | Mimura . | |
| 5,108,205 | | 4/1992 | Stone . | |
| 5,156,464 | | 10/1992 | Sakai . | |
| 5,356,127 | * | 10/1994 | Moore et al. | 271/11 X |
| 5,391,051 | * | 2/1995 | Sabaiter et al. | 414/797.2 |
| 5,510,815 | | 4/1996 | Linder et al. . | |
| 5,797,597 | * | 8/1998 | Kakuta et al. | 271/98 |
| 5,836,580 | * | 11/1998 | Hansen et al. | 271/9.13 X |
| 5,848,789 | * | 12/1998 | Ochi et al. | 271/258.01 |
| 6,000,693 | * | 12/1999 | Tranquilla | 271/263 |
| 6,015,146 | * | 1/2000 | Siegel | 271/98 |
| 6,076,819 | * | 6/2000 | Koike et al. | 371/3.07 X |
| 6,123,330 | * | 9/2000 | Schaal | 271/31 X |

* cited by examiner

*Primary Examiner*—Christopher P. Ellis
*Assistant Examiner*—Kenneth W Bower

(57) ABSTRACT

A system for regulating the vacuum hold pressure in a printer based upon the physical characteristics of the print media that is directed through the printer. In one embodiment, the characteristic of a sheet of media is detected before or as the sheet reaches the carrier. The vacuum pressure level is thus regulated in response to the physical characteristic of the sheet, thereby to have applied to that particular media a level of vacuum pressure that prevents problems that arise when pressure levels are too low (for example, inadvertent shifting of the paper) or too high (for example, paper deformations that reduce print quality).

14 Claims, 4 Drawing Sheets

REGULATING VACUUM HOLD OF MEDIA IN A PRINTER

TECHNICAL FIELD

This invention relates to systems that employ vacuum pressure for holding print media as the media is advanced through a hard copy device such as a printer.

BACKGROUND AND SUMMARY OF THE INVENTION

An inkjet printer includes one or more ink-filled pens that are mounted to a carriage in the printer body. Normally, the carriage is scanned across the width of the printer as paper or other print media is advanced through the printer. Each ink-filled pen includes a printhead that is driven to expel droplets of ink through an array of nozzles in the printhead toward the paper in the printer. The timing and nominal trajectory of the droplets are controlled to generate the desired text or image output and its associated quality.

As the sheet of print media is advanced through the printer, it must be secured so that the high-resolution printing can occur. One method of holding the sheet is to direct it against an outside surface of a moving carrier such as perforated drum. Suction is applied to the inside surface of the carrier for holding the sheet against the moving carrier. The carrier is arranged to move the sheet into and out of a location adjacent to the pens for receiving the ink.

It is important to apply the proper level of suction to a system like the one just described. The suction, or vacuum pressure (here the term "vacuum" is used in the sense of a pressure less than ambient), must be applied at a level sufficient for ensuring that the sheet of print media remains in contact with the carrier. Also, the level must be high enough to hold the sheet flat, to eliminate wrinkling or cockling of the sheet during printing.

If the vacuum pressure level is too high, the surface of the sheet may become deformed in the vicinity of the perforations. As a result, the ink droplets will not strike the surface of the sheet as intended, and print quality will suffer. Also, power is wasted if the vacuum level is unnecessarily high.

Moreover, when liquid ink is applied to the sheet, it is important to ensure that that vacuum pressure level is not so high as to draw the ink completely through the sheet, such that the ink appears on the other side as an undesirable effect known as "strike through."

The foregoing considerations concerning vacuum levels are complicated by differences in the physical characteristics of the variety of print media that can be handled by modern printers. The print media can be thin, relatively lightweight cut paper, relatively thick or stiff media known as transparencies, heavy photo stock, etc. In short, one level of vacuum pressure will not be appropriate for the wide variety of print media available to a user.

The present invention is directed to a system for regulating the vacuum hold pressure in a printer based upon the physical characteristics of the print media that is directed through the printer.

In one preferred embodiment of the invention, the characteristic of the paper is detected before or as the paper reaches the carrier. The vacuum pressure level is thus regulated in response to the paper characteristic, thereby to have applied to that particular media a level of vacuum pressure that is best (remove cockle, avoid strike through, etc.) for that media.

DETAILED DESCRIPTION OF PREFERRED EMBODIMENTS

Figure 1:
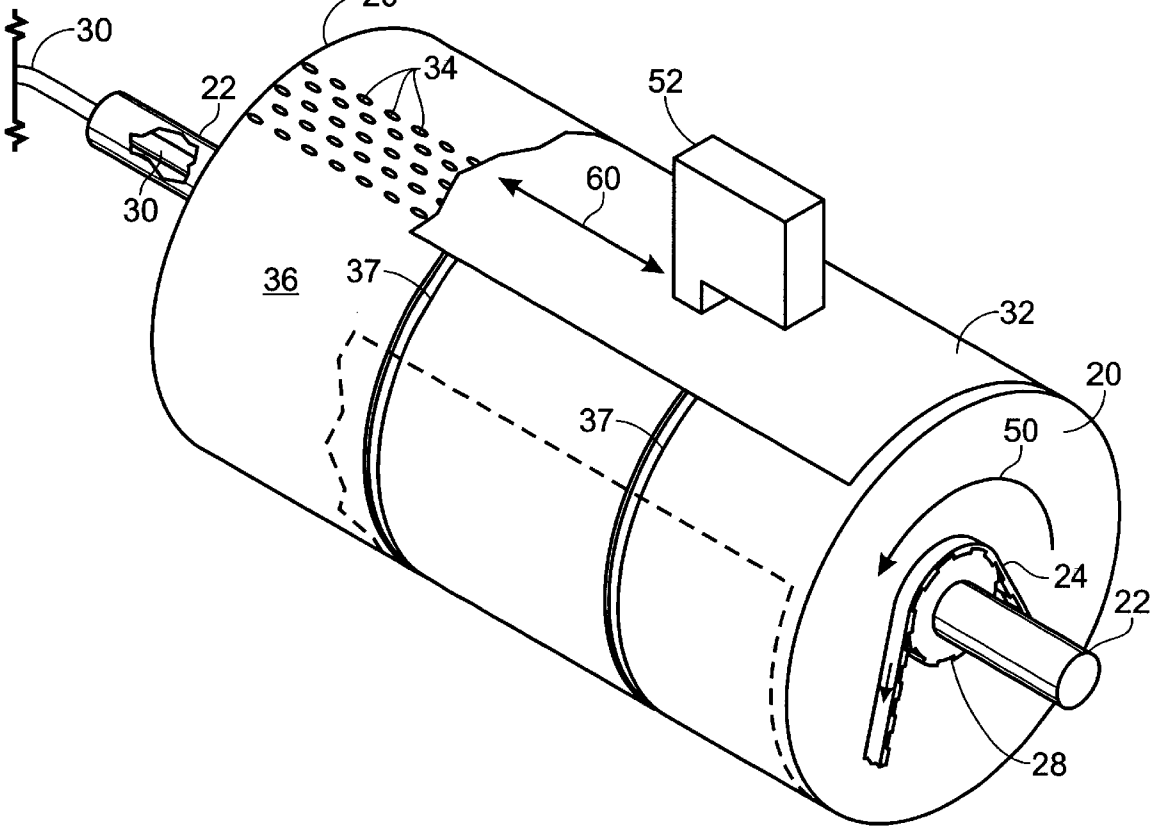
FIG. 1 is a perspective view of a media carrier of a printer, which carrier is adaptable for use with the vacuum-hold regulating system of the present invention.
Figure 2:
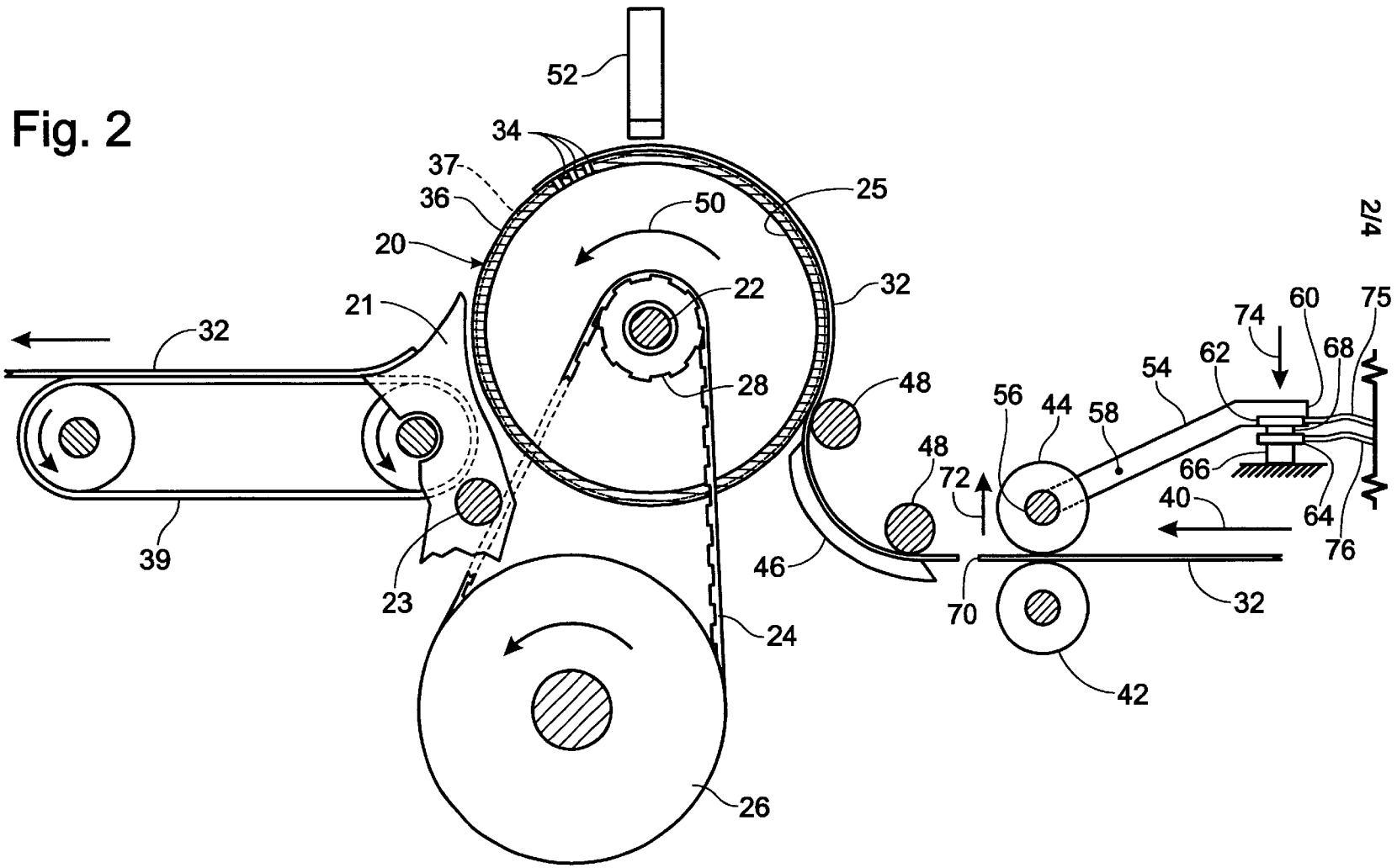
FIG. 2 is a side view of the media carrier, including media handling and sensing components of the present invention.

With reference to FIGS. 1 and 2, a preferred embodiment of the present invention is operable with printer media carrier, such as a drum 20, that is supported by a shaft 22 within a printer. The drum 20 preferably has a circumference of about 50 cm, although any of a variety of drum sizes will suffice.

An endless drive belt 24 engages a gear 28 that is fixed to one end of the drum 20. That belt also engages a drive pulley 26 (FIG. 2). In a preferred embodiment, a motor (not shown) continuously drives the pulley 26 to rotate the drum whenever a printing operation is carried out.

Figure 3:
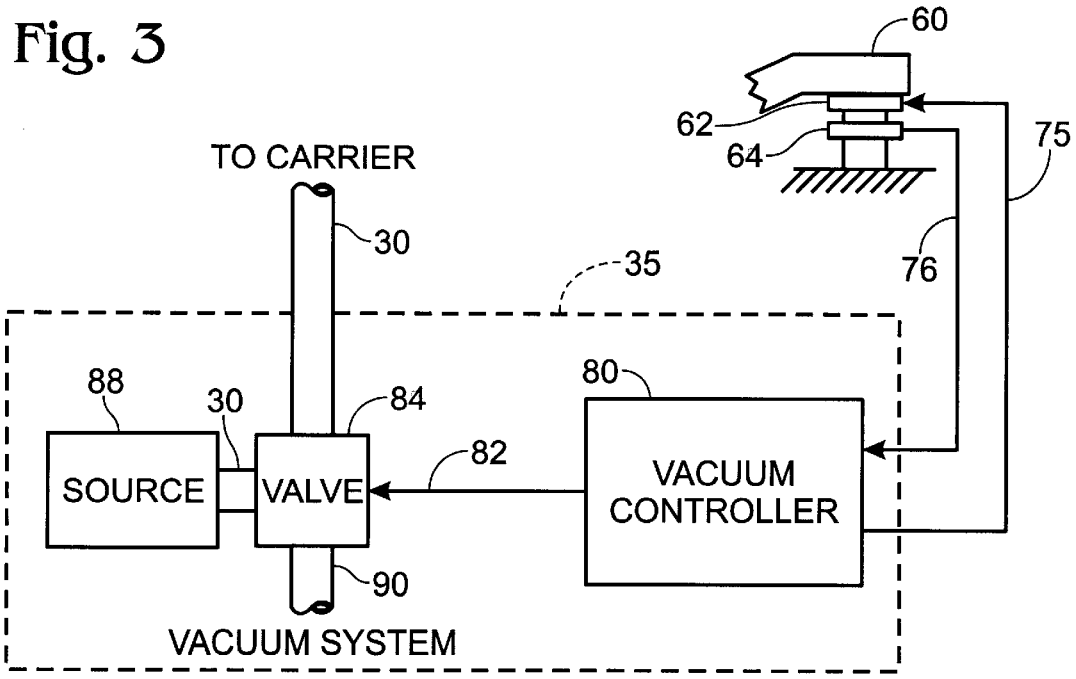
FIG. 3 is a block diagram of the present system.

The other end of the drum shaft 22 is hollow. A vacuum line 30 enters the hollow interior of the drum 20 through the shaft 22. The other end of the vacuum line 30 is connected to a regulated vacuum system 35 (FIG. 3). The vacuum is applied to the interior of the drum as a mechanism for securing print medium, such as paper 32, to the drum 20 as the paper is advanced through the printer over the drum. To this end, the drum is perforated with vacuum ports 34 that extend between the interior surface 25 of the drum and the outer surface 36 of the drum. The suction present in the ports 34 secures to the drum outer surface 36 the paper 32 that is directed into contact with the drum, as is described next.

FIG. 2 illustrates in somewhat simplified fashion a portion of the path of the paper 32 through the printer. It is noteworthy here that although "paper" will be hereafter referred to as the print medium, any of a number of materials can be used as the medium in such printers, such as thin, relatively lightweight cut paper, relatively thick or stiff media known as transparencies, heavy photo stock, etc. As will be described, the present invention provides for regulating the vacuum system 35 so that a level of suction is applied by the vacuum system to match the physical characteristics of the media.

The paper 32 is picked from an input tray and driven into the paper path in the direction of arrow 40. The leading edge of the paper is fed into the nip between a drive roller 42 and an idler or pinch roller 44. From there the paper 32 is driven in a controlled manner into contact with a curved guide 46 that, in cooperation with guide rods 48, directs the leading edge of the paper 32 into tangential contact with the exterior surface 36 of the drum 20. The guide rods are removed from contact with the paper as soon as the paper is loaded.

As the vacuum ports 34 of the drum rotate into contact with the paper 32, the suction established between the paper and drum secures the paper to the drum, and the drum continues to rotate in the direction of arrow 50. The paper 32 on the drum is advanced to be located adjacent to one or more pens 52 of the printer. The pens are controlled to apply ink to the paper during a printing operation.

Once the printing operation respecting a particular sheet of paper is complete (the paper may be rotated past the pens several times to complete the operation) the paper is removed from the drum. This can be carried out by the controlled, temporary movement of guide prongs 21 (FIG. 2) that pivot about a post 23 into a circumferential grooves 37 that are formed in the drum. This redirects the paper from the drum to a conveyor belt 39 that delivers the paper to a collection tray.

In one preferred embodiment of the present invention, the thickness characteristic of the paper 32 is detected as the paper approaches the drum 20. To this end, a lever 54 is connected at one end to the shaft 56 of the pinch roller 44. The lever is pivotally connected between its ends a pivot 58, which is a fixed point relative to the printer. The remote end 60 of the lever has mounted to it an electrode 62 that faces another electrode 64 that is aligned with the first and is mounted to a fixed, electrically insulated pad 66 in the printer.

A deformable, conductive member 68 is located between and in contact with the two electrodes 62, 64. The member 68 is made of conductive rubber in which the electrical conductivity changes in proportion to the pressure applied to it. In this regard, a low voltage is applied via lead 75 to the movable electrode 62 by the vacuum controller 80 (FIG. 3), discussed more below. Another lead 76 connects the fixed electrode 64 with the vacuum controller. Thus, the magnitude of the signal appearing on line 76 to the vacuum controller corresponds to that applied on line 75, as affected by changes in the shape (i.e., conductivity) of the deformable member 68.

As the leading edge 70 of a sheet of paper 32 passes between the drive roller 42 and the pinch roller 44, the pinch roller 44 is lifted (arrow 72) by an amount corresponding to the thickness of the paper. As a result, the lever 54 pivots about point 58 such that the remote end 60 of the lever moves downwardly (arrow 74) and compresses the conductive member 68. The attendant change in the conductivity of the member 68 varies the signal appearing on line 76 (hereafter referred to as the thickness signal) to the vacuum controller 80. The location of the pivot 58 is selected to multiply the distance of roller 44 movement by an amount sufficient to provide measurable changes in the compression of the conductive member 68.

The vacuum controller 80 monitors the thickness signal and adjusts the level of vacuum applied to the drum via line 30. In this regard, the vacuum controller 80 may be incorporated into the overall printer controller and include suitable analog to digital converters for controlling the just described low-voltage circuit between it and the remote end of the lever 60.

The vacuum controller 80 is also provided with suitable drivers for controlling via line 82 a conventional electronically controlled pneumatic valve 84. The valve 84 is connected to the vacuum line 30, which extends between a constant level vacuum source 88 and the drum 20. The valve 84 is also interconnected between the line 30 and an atmospheric vent 90. The valve is controlled by the controller 80 (as noted, in response to the thickness signal) to open the vent 90 by an amount sufficient to alter (lower) the vacuum pressure that in the line 30, hence in the interior of the drum 20. In this regard, the vacuum controller includes a look-up table or the like to correlate the thickness signal to the desired valve adjustment. This table can be empirically derived through tests of various media types.

One of ordinary skill will appreciate that there are many other ways available for adjusting the vacuum level applied to the drum. For instance, the source itself could be controllable (such as be varying fan speed) to increase or decrease the level as needed in response to the thickness signal.

Figure 4:
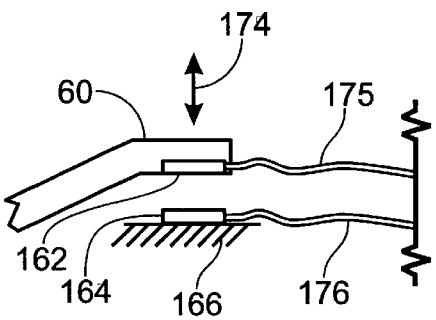
FIG. 4 is a detail view of one preferred media-characteristic sensing apparatus in accord with the present invention.

FIG. 4 represents an alternative means for sensing the movement of the remote end 60 of lever, which movement, as explained above, relates to the thickness of the paper fed to the drum. In this embodiment, the remote end 60 of the lever has mounted to it an electrode 162 that faces and is spaced from another electrode 164 that is that is mounted to a fixed, electrically insulated pad 166 in the printer. Leads 175, 176 make a circuit as described above, except that the electrodes 162, 164 act as a capacitor. Accordingly, movement of the lever end (arrow 174) in response to the engagement of the roller 44 with the leading edge 70 of the paper, varies the capacitance across the two electrodes, which change is apparent on line 176, which is received by the vacuum controller 80 as the thickness signal. The vacuum pressure level is then adjusted as needed, as discussed above.

It is contemplated that changes in inductance could be employed to sense movement of the lever end. For instance, the movable electrode 162 of FIG. 4 could be a ferromagnetic member moving relative to a coil, which would substitute for the fixed electrode 164, the coil having current directed through it by the controller 80. The inductance change attributable to the relative movement of ferromagnetic member and coil would alter accordingly the signal appearing on line 176. It is also contemplated that the movement of an electrode (such as electrode 164) though a magnetic field could be sensed by an eddy-current proximity sensor that detects the eddy current changes in the electrode.

Figure 5:
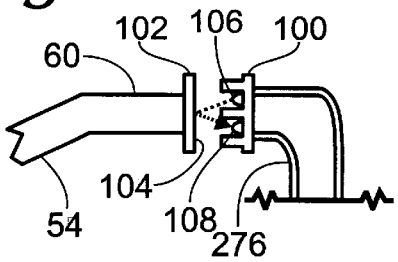
FIG. 5 is a detail view of another preferred media-characteristic sensing apparatus in accord with the present invention.

FIG. 5 represents an alternative means for sensing the movement of the remote end 60 of lever 54. This embodiment uses an optical sensor 100. Here, the end 60 of the lever is equipped with a plate 102. The plate has a surface 104 that faces the emitter 106 (such as an infrared emitter) and detector 108 (such as a photodiode) of the optical sensor 100. The surface 104 is coated with reflective material in a pattern where the width of the material, hence the intensity of the emitter light reflected back to the detector, varies in the direction of movement of the lever end 60 (up and down in FIG. 5). As a result, the output from the sensor 100 that is applied via line 276 to the vacuum controller (the thickness signal) varies with the lever movement, which, as described, relates to the paper thickness, which in turn correlates to a preferred vacuum pressure level to be applied to the drum interior. It will be appreciated that many other optical-type sensors can be used to detect and quantify motion of the lever end.

The various sensors described herein can be calibrated in a number of ways. For instance, one could configure the roller 44 with a known runout, and as the roller turns, the variation of the signal will indicate the output change of the sensor associated with a position change of the roller that corresponds to the runout. Alternatively, such calibration (and subsequent sensing) can be made by replacing roller 44 with a pin that rides in a predetermined, variable-depth notch formed in roller 42.

Figure 6:
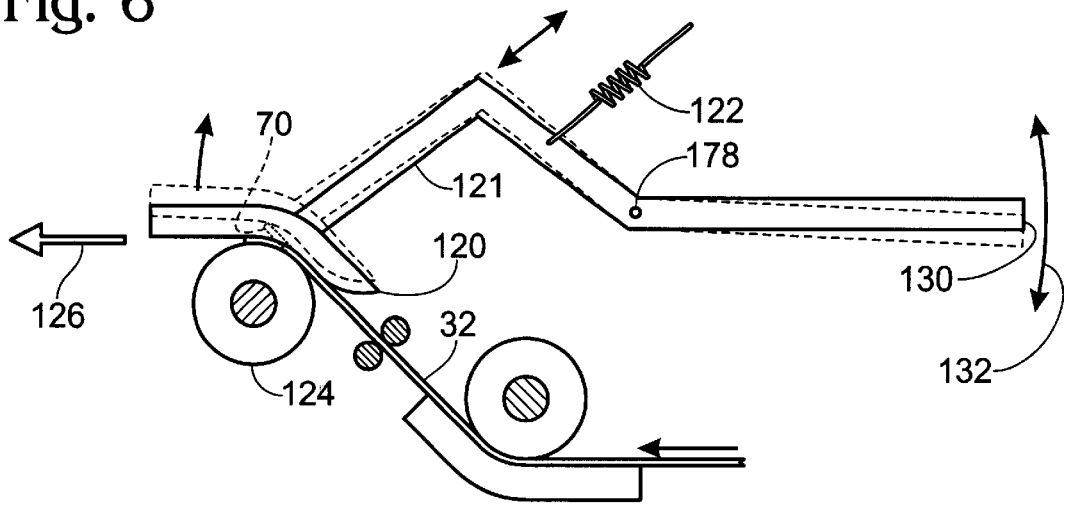
FIG. 6 is a detail view of another preferred media-characteristic sensing apparatus in accord with the present invention.

FIG. 6 shows another alternative means for sensing the movement of the remote end 60 of lever 54. In this case, the characteristic of the paper that is detected can be considered as the stiffness of the paper. That is, two different papers having the same thickness may have different stiffnesses (resistance to bending). Moreover, such papers, owing to the difference in stiffness, may require different vacuum holding pressures to avoid the problems discussed above.

The embodiment of FIG. 6, which can be used alone or in conjunction with the thickness detection approaches discussed above, provides the vacuum controller 80 with a measure of the paper's stiffness (hereafter referred to as the stiffness signal) so that the vacuum pressure level can be adjusted accordingly (using, for example, a look-up table relating the stiffness signal to the desired vacuum level).

In FIG. 6, the leading end of the paper 70 is directed into the path of a curved guide 120. In the absence of any appreciable paper stiffness, the guide 120, which is carried on the end of a lever 121 and urged by a spring 122 toward a feed roller 124, would immediately bend the paper into a desired path, shown as arrow 126.

In the event the paper has an appreciable amount of stiffness, the initial contact between the leading edge 70 (note dashed lines for 70) and guide 120 will deflect the guide slightly, thereby causing, at least momentarily, the lever 121 to pivot about its pivot point 178. The lever is configured so that this pivot motion moves its remote end 130 in a manner that can be detected by any of the sensing mechanisms described above, so that the vacuum pressure level can be adjusted accordingly.

Although preferred and alternative embodiments of the present invention have been described, it will be appreciated by one of ordinary skill that the spirit and scope of the invention is not limited to those embodiments, but extend to the various modifications and equivalents as defined in the appended claims.

For example, there may be fewer or more perforations in the drum as compared to what is depicted. Also, the drum need not be a rigid, cylindrical member. For instance, the drum may be more like a porous conveyor belt of any given configuration.

Further, although a lever was primarily described in the foregoing, it will be clear that any member that engages the paper, the movement of which member can be sensed, may be used to detect the paper characteristics.

Figure 9:
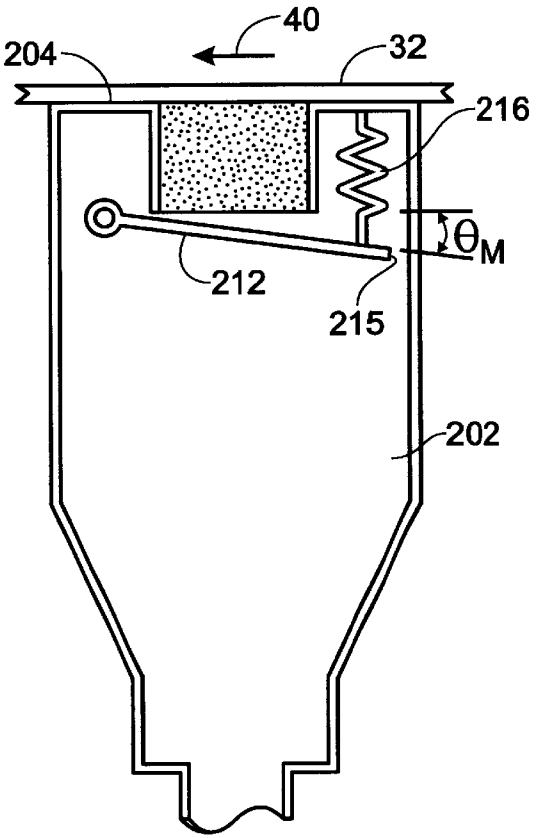
FIGS. 7–9 depict the calibration and use of another media-characteristic sensing apparatus in accord with the present invention.
Figure 8:
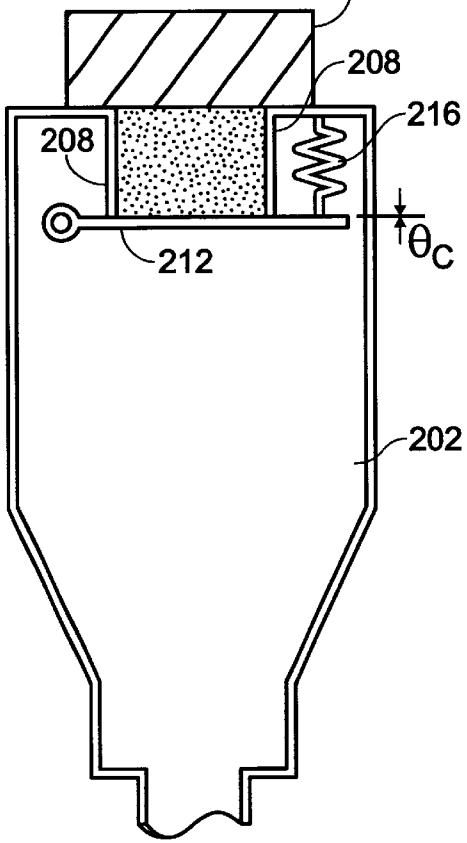
Figure 7:
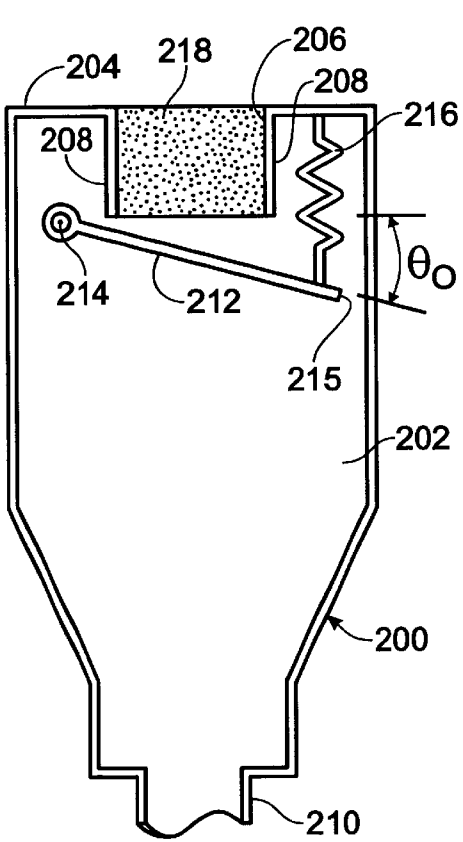

Also, other media characteristics may be detected, such as porosity, in the course of applying the most appropriate vacuum pressure level. One preferred embodiment of a media-porosity sensing system is shown in FIGS. 7–9.

The porosity sensor includes a head 200 that defines a substantially closed chamber 202 that underlies the path of the paper 32 as the paper moves toward the drum 20. The head 20 includes a flat contact surface 204 across which the paper 32 is guided (See FIG. 9). The contact surface is interrupted with a slot 206 that is defined by side walls 208 that extend from the surface 204 into the chamber 202.

The chamber 202 is connected by a conduit 210 to a constant-level vacuum source. In this regard, the conduit 210 may be connected to the above-described source 88, preferably in a manner that ensures constant vacuum pressure in conduit 210.

A lever-like valve 212 is pivotally mounted (as at pivot 214) in the chamber 202. The free end 215 of the valve is connected to a spring 216 that normally urges the valve into a closed position (See FIG. 8) so that the valve 212 is seated against the innermost ends of the slot side walls 208, thereby to occlude fluid communication between the chamber 202 and the slot 206.

The characteristics of the spring 216 are selected so that whenever the slot 206 is obstructed at the contact surface 204 (that is, so that no air is free to move into the chamber 202), the levered valve 212 will move into the closed position (FIG. 8). When the slot 206 is not obstructed, the vacuum pressure in the chamber is sufficient to deflect the valve 212 from the closed position, thus extending the spring 216 (FIG. 7).

It will be appreciated that the movement of the free end 215 of the levered valve 212 can be sensed by any of a number of techniques, such as those described above. Moreover, the amount of deflection of the valve 212 (that is, between the closed position of FIG. 8 and the completely open position of FIG. 7) will vary depending on the porosity of the material, such as paper 32, that is directed over the slot 206.

The apparatus just described is first calibrated by sensing the position of the end 215 when the slot 206 is unobstructed. This deflection is shown by the angle $\theta_0$ in FIG. 7. In addition to controlling the vacuum pressure in the chamber 202, and the characteristics of the spring 216, the preferred maximum amount of end 215 deflection can be controlled by providing the slot 206 with flow restricting material, such as foam 218. The maximum deflection $\theta_0$ is established to be greater than would occur if the slot were covered with the most porous print media available.

A non-porous obstruction 220 may then be placed over the slot 206 to establish for calibration the precise position of the valve end 215 when the valve is in the closed position, shown as angle $\theta_c$ in FIG. 8 (0 degrees). Thereafter, the apparatus is used by directing paper 32 in the direction shown by arrow 40. Depending on the porosity of the paper (which, as noted can be any print media), the lever 212 will deflect by an amount $\theta_m$ that is sensed and, as discussed above, correlated to a preferred vacuum pressure level to be applied to hold the paper to the drum 20.

What is claimed is:

1. A method of regulating vacuum hold in a printer that includes a perforated carrier for supporting a sheet of print media that is fed onto one side of the carrier, wherein the carrier is provided with vacuum pressure on another side for holding the sheet to the carrier, the method comprising the steps of:

detecting a thickness of the sheet and a stiffness of the sheet;

providing a signal indicative of the thickness and stiffness; and regulating the vacuum pressure in response to the signal.

2. The method of claim 1 wherein the detecting step includes:

providing a lever that is pivotally mounted adjacent to the carrier;

contacting the sheet with a first part of the lever thereby to move the lever about the pivot; and sensing movement of a second part of the lever, which movement is attributable to the contact between the sheet and the lever.

3. The method of claim 2 wherein the sensing step includes:

aligning a deformable, electrically conductive member with the second part of the lever such that the movement of the second part of the lever deforms the deformable member; and sensing a change in the conductivity of the deformable member.

4. The method of claim 2 wherein the sensing step includes:

connecting a first electrode to the second part of the lever;

aligning a second electrode with the first electrode; and sensing a change in capacitance across the first and second electrode, which change is attributable to the movement of the second part of the lever.

5. The method of claim 2 wherein the sensing step includes:

connecting a first inductance member to the second part of the lever;

aligning a second inductance member with the first inductance member; and sensing a change in inductance that is attributable to the movement of the second part of the lever, which thereby moves the first inductance member relative to the second inductance member.

6. The method of claim 2 wherein the sensing step includes:

aligning an optical sensor with the second part of the lever such that movement of the second end of the lever changes an output signal of the optical sensor; and sensing the change in the output signal.

7. A vacuum hold regulation system for a printer comprising:

a perforated carrier having a first side against which a sheet of print media may be directed;

a vacuum source connected to the carrier to provide a level of suction on a second side of the carrier, which suction is communicated to the first side through the perforations thereby to hold to the carrier a sheet of print media that is directed to the first side of the carrier;

a regulator responsive to a control signal for regulating the level of suction; and a sensor for sensing a stiffness characteristic of the sheet of print media that is directed against the first side of the carrier and for providing to the regulator a control signal that is indicative of the stiffness characteristic.

8. The system of claim 7 wherein the regulator includes a valve connected between the vacuum source and a vent, the valve being controllable to open and close the vent, thereby to regulate the level of suction.

9. The system of claim 7 wherein the sheet moves along a path to be directed against the first side of the carrier, the system further comprising:

a lever mounted for pivotal movement near the carrier and having one part in the path of the sheet so that the sheet and lever contact as the sheet is directed to the first side of the carrier; and the sensor being located near the lever for sensing movement of the lever.

10. The system of claim 9 wherein the sensor is a deformable, electrically conductive member that is aligned with a second part of the lever such that movement of the lever deforms the deformable member and thereby changes its conductivity.

11. The system of claim 9 wherein the sensor includes a pair of electrodes, one of which electrodes is attached to the lever to move with the lever and relative to the other electrode so that a value of capacitance across the electrodes changes with movement of the lever.

12. The system of claim 9 wherein the sensor includes an optical emitter for providing light to an associated detector, the emitter and detector being arranged so that the movement of the lever changes the intensity of light provided to the detector.

13. A vacuum hold regulation system for a printer comprising:

a perforated carrier having a first side against which a sheet of print media may be directed;

a vacuum source connected to the carrier to provide a level of suction on a second side of the carrier, which suction is communicated to the first side through the perforations thereby to hold to the carrier a sheet of print media that is directed to the first side of the carrier;

a regulator responsive to a control signal for regulating the level of suction; and a sensor for sensing a porosity characteristic of the sheet of print media and generating the control signal.

14. The system of claim 13 wherein the sensor includes a porous support member for supporting the sheet of print media while detecting the porosity characteristic of the sheet.

* * * * *